United States Patent [19]

Figura

[11] 4,204,516

[45] May 27, 1980

[54] BACK-PACKING STOVE FOR A SIERRA-TYPE CUP

[76] Inventor: Gene B. Figura, 1502 Linden Dr., Ames, Iowa 50010

[21] Appl. No.: 873,257

[22] Filed: Jan. 30, 1978

[51] Int. Cl.[2] ..... F24C 1/16

[52] U.S. Cl. ..... 126/9 R; 126/38; 248/311.1 A

[58] Field of Search ..... 126/9 R, 9 B, 9 A, 25 R, 126/29, 30, 59, 62, 65, 333, 38; 248/311.1 A, 312, 316 D

[56] References Cited

U.S. PATENT DOCUMENTS

| | | | |
|---|---|---|---|
| 506,058 | 10/1893 | Mings | 126/59 |
| 1,058,288 | 4/1913 | Brown | 126/9 B |
| 1,163,864 | 12/1915 | Schlereth | 126/38 |
| 1,262,209 | 4/1918 | King | 126/38 |
| 1,456,382 | 5/1923 | Kincannon | 126/9 B |
| 1,458,409 | 6/1923 | Higham | 126/9 R |
| 1,562,747 | 11/1925 | Ellis | 126/38 |
| 1,656,480 | 1/1928 | Goldberg et al. | 126/38 |
| 2,573,772 | 11/1951 | Nysten | 126/29 |
| 2,861,562 | 11/1958 | Ross et al. | 126/38 |
| 4,140,099 | 2/1979 | Newport | 126/9 A |

FOREIGN PATENT DOCUMENTS

| | | | |
|---|---|---|---|
| 767388 | 7/1934 | France | 126/29 |

*Primary Examiner*—Carroll B. Dority, Jr.

*Assistant Examiner*—Lee E. Barrett

*Attorney, Agent, or Firm*—Zarley, McKee, Thomte, Voorhees & Sease

[57] ABSTRACT

A collapsible back-packing stove for use with a Sierra-type cup is disclosed, which includes a container comprising a back portion, two opposite side portions of substantially equal size pivotally connected to the back portion, a bottom portion of substantially equal size to the back portion and pivotally connected to the back portion, and a top portion pivotally connected to the back portion. The top, back, front and side portions align to form an open-sided container with a plurality of vertically-spaced brackets within the container and pivotally secured to the back portion. The brackets are adapted to securely support a Sierra-type cup in a horizontal position during use, and pivot downwardly against the back portion when not in use or upon disassembly of the stove. The top portion provides a table surface and protects the cooking vessels from insects and falling debris, or it may be pivoted upwardly to allow access to the interior of the stove. The bottom portion supports the burner and extends outwardly from the container to provide a working surface during the cooking process. To transport the stove, the burner is removed and the brackets, the side portions, the top portion, and the bottom portion are respectively pivoted towards the back portion to form a thin rectangular compact package.

6 Claims, 7 Drawing Figures

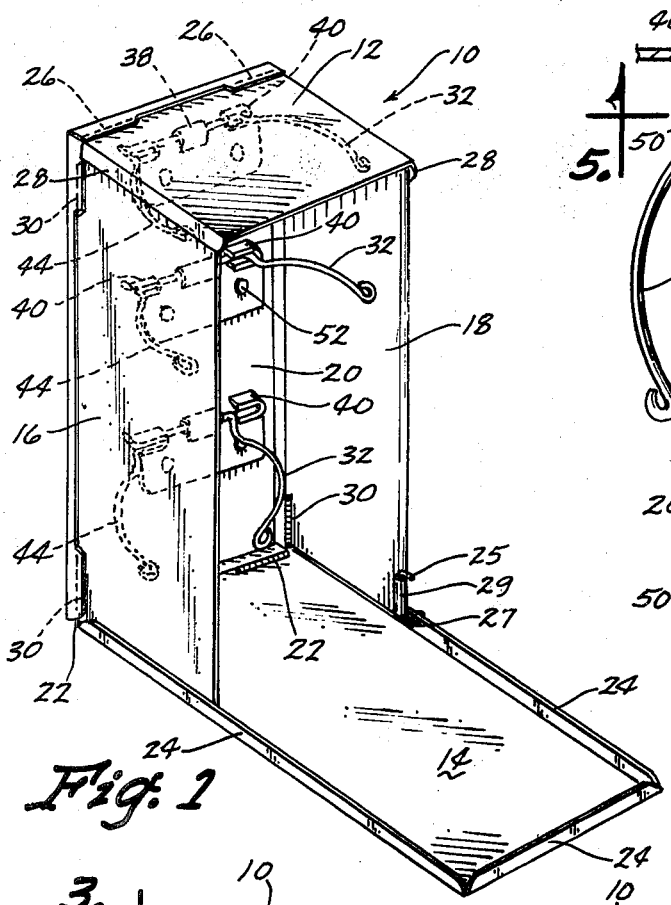
Fig. 1
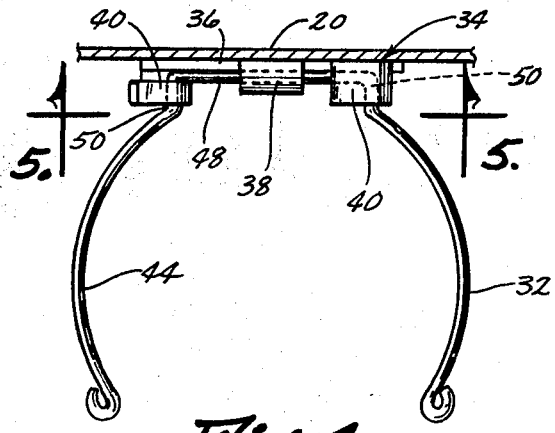
Fig. 4
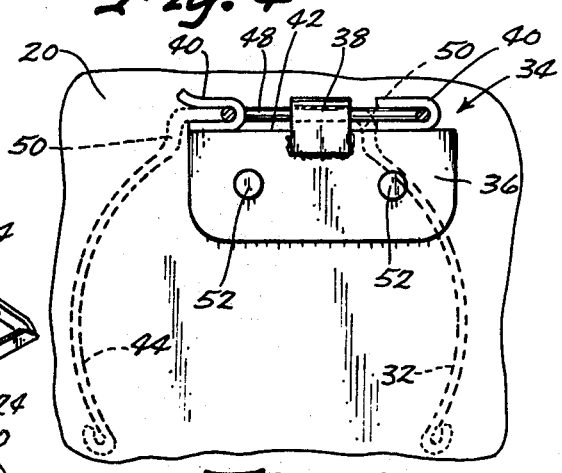
Fig. 5
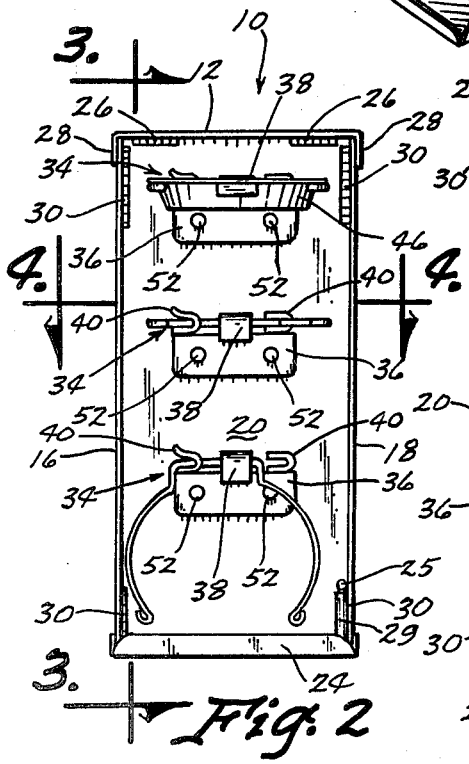
Fig. 2
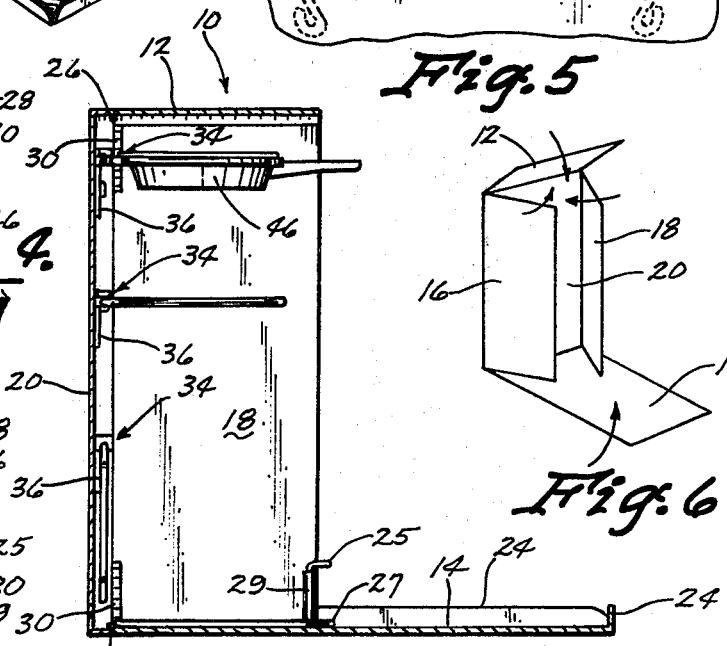
Fig. 3
Fig. 6
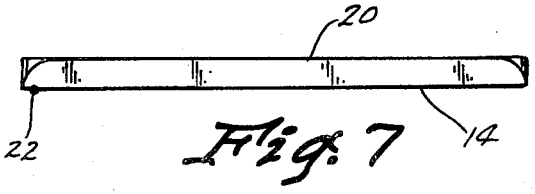
Fig. 7

BACK-PACKING STOVE FOR A SIERRA-TYPE CUP

BACKGROUND OF THE INVENTION

This invention relates to a portable stove device and more particularly to a collapsible back pack cook stove adapted for use with a Sierra cup. Prior stove devices do not not provide the light weight, collapsible, compact features together with the adaptability to the use of Sierra cups necessary for back packing.

SUMMARY OF THE INVENTION

A collapsible back-packing stove for Sierra type cups is disclosed which includes a container comprising a top portion, two opposite side portions of substantially equal size, a back portion and a bottom portion of substantially equal size to the back portion. The top, side and bottom portions are pivotally mounted to the back portion to form an open sided container. A plurality of vertically spaced brackets are pivotally secured to the back portion within the container. A burner is located within the container below the brackets. The brackets are adapted to securely hold a Sierra cup at various distances from the burner. The bottom portion supports the burner and provides work space during the cooking process. The top portion covers the container and prevents foreign matter from falling into the Sierra cups during cooking. The top portion also provides table space after the cooking process. The top portion may be pivoted upward to provide access to the Sierra cups and the food may be eaten directly out of the container portion. For transporting, the brackets pivot downward against the back portion while the side portions, the top portion and the bottom portion pivot toward the back portion, respectively, to form a thin, compact rectangular package.

An object of this invention is to provide a light weight, compact back-packing stove compatible with Sierra cups.

A further object of the invention is to provide a back-packing stove that is collapsible into a thin, light weight compact package.

A still further object of the invention is to provide a back-packing stove that occupies very little space in the pack during travel.

A still further object of the invention is to provide a back-packing stove adaptable to different forms of burners.

A still further object of the invention is to provide a back-packing stove that has an open front, receives and securely holds Sierra cups, and collapses into a compact size for back packing.

A still further object of the invention is to provide a back-packing stove which is economical to manufacture, durable in use, and refined in appearance.

BRIEF DESCRIPTION OF THE DRAWINGS

FIG. 1 is a perspective view of the invention.

FIG. 2 is an elevational front view.

FIG. 3 is a sectional side view seen on line 3—3 of FIG. 2.

FIG. 4 is an enlarged partial top sectional view seen on line 4—4 of FIG. 2.

FIG. 5 is a sectional view seen on line 5—5 of FIG. 4.

FIG. 6 is a perspective illustration of the collapsing of the device into its carrying mode.

FIG. 7 is a side view of the invention in its collapsed carrying position.

DESCRIPTION OF THE PREFERRED EMBODIMENT

The collapsible stove of this invention is generally referred to by the reference numeral 10 and is comprised of a top portion 12, a bottom portion 14, side portions 16 and 18, and back portion 20.

Bottom portion 14 is pivotally mounted to the back portion 20 by hinge 22 located at the rear edge of bottom portion 14. A lip 24 is located along the front and side edges of bottom portion 14 as shown in FIG. 1. Top portion 12 is pivotally attached to back portion 20 by hinge 26. Lip 28 is located on the side edges of top portion 12 as shown in FIGS. 1 and 2. Side portions 16 and 18 are pivotally mounted to back portion 20 by hinges 30. In the cooking position of FIG. 1, side portions 16 and 18 are aligned against lips 24 and 28 of bottom portion 14 and top portion 12, respectively, with pivoting clip 25, rotatably mounted to side 18 by sleeve 29, being detachably received by aperture 27 in lip 24 to securely hold side 18 against lip 24 to form an open sided container.

Arcuate shaped bracket 32 is pivotally mounted to back portion 20 by hinge assembly 34. Hinge assembly 34 is comprised of hinge plate 36, bracket sleeve 38 and U-shaped retainer clips 40. As shown in FIG. 5, retainer clips 40 are securely attached to the top edge 42 of hinge plate 36 with the open side of retainer clips 40 disposed in a direction parallel to the top edge of top portion 12. Bracket 32 comprises an arcuate forward section 44 for securely supporting a Sierra cup 46 (FIG. 3), a straight rear section 48 that is slidably received by bracket sleeve 38, and a straight middle section 50 approximately perpendicular to and connecting rear section 48 to forward section 32. Section 50 slides into retainer clips 40 to hold bracket 32 in a secure position perpendicular to back portion 20 as shown in FIG. 3. Hinge assembly 34 is securely attached to back portion 20 by means of rivets 52 through hinge plate 36 as shown in FIG. 5. To pivot bracket 32 downward against back portion 20, section 50 is pushed laterally out of retainer clips 40 thereby releasing bracket 32 to pivot within bracket sleeve 38 downward against back portion 20. As shown in FIGS. 2 and 3, three brackets are attached to back portion 20 at various heights above bottom portion 14. A small conventional burner (not shown) such as an alcohol burner or Sterno burner, is placed directly beneath brackets 32 and supported by bottom portion 14. The variation in height of the brackets from bottom portion 14 allows for different applications of heat to the cups when a non-adjustable burner is used.

In operation, top portion 12, bottom portion 14, and side portions 16 and 18 are pivoted away from back portion 20 to form an open sided container as shown in FIG. 1 with side portions 16 and 18 being constrained by lips 24 and 28 of bottom portion 14 and top portion 12, respectively, and pivoting clip 25 being rotated in sleeve 29 so as to be detachably received by aperture 27 to securely hold side 18 against lip 24. The burner is placed atop bottom portion 14 directly beneath brackets 32. Brackets 32 are pivoted upward away from back portion 20 to a position approximately perpendicular to back portion 20 and pushed laterally such that straight section 50 of bracket 32 is received by retainer clips 40 and held in a secure position. A Sierra cup 46 containing the food to be heated is then placed in the bracket 32 desired for heating. Bracket 32 is adapted to receive and securely hold a standard Sierra cup. Any number of the brackets 32 may be used at one time with the lowest bracket receiving direct heat from the burner and the two higher brackets receiving the rising heat. As the open air tends to cool food and drink very quickly, the upper two brackets are of great use in keeping food warm. The cups 46 may be removed independently after the food is prepared by lifting the cups out of the brackets 32 and withdrawing them from the container. Top portion 12 may be used as a raised table surface when seated on the ground. Top portion 12 may also be pivoted upwards so that the food may be directly eaten out of cups 46 as they remain securely in brackets 32. Bottom portion 14 provides a working surface at the front of the stove for mixing ingredients, holding utensils and holding seasoning during the cooking process.

To fold collapsible stove 10 into the thin rectangular package shown in FIG. 7, brackets 32 are pushed transversely out of retainer clips 40 and pivoted downwardly to lie flat against back portion 20. Pivoting clip 25 is detachably released from aperture 27 and rotated away from lip 24. As the arrows in FIG. 6 indicate, side portions 16 and 18 are pivoted inwardly against back portion 20, top portion 12 is pivoted downwardly against side portions 16 and 18, and bottom portion 14 is pivoted upwardly to form the flat compact configuration shown in FIG. 7 which utilizes very little space in a back pack. The stove is assembled in a simple, easy manner by reversing the order of the previously noted steps, and thus provides a light, compact, stove compatible with the very popular Sierra cups.

Thus, it can be seen that the device accomplishes at least all of its stated objectives.

What is claimed is:

1. A collapsible back-pack cook stove for supporting a burner and at least one food container to be heated by the burner, comprising, a container comprising a back portion, two opposite side portions, a top portion, and a bottom portion; said side portions being of substantially equal size;

said back and bottom portions being of substantially equal size;

first means pivotally connecting said side portions to the sides of said back portion;

second means pivotally connecting one end of said bottom portion to the bottom of said back portion;

third means pivotally connecting said top portion to the top edge of said back portion;

said bottom portion adapted to lie flat for supporting a burner thereon with said back portion extended upwardly therefrom;

at least one spaced bracket pivotally secured to said back portion at a position vertically spaced from said bottom portion;

and means for selectively holding said bracket in a horizontal position with respect to said back portion thereby to support a food container above said bottom surface so that the food container may be heated by a burner on the bottom surface;

said side portions being pivotable toward said back portion, said top portion being pivotable toward said back portion and said bottom portion being pivotable toward said back portion to meet said back portion and enclose said side portions and said top portion therebetween, thereby to from a generally flat parcel.

2. The device of claim 1 wherein said bracket includes means to receive a cup-shaped cooking utensil.

3. The device of claim 2 wherein said bracket is U-shaped.

4. The device of claim 1 wherein a plurality of brackets are vertically spaced and pivotally secured to said back portion.

5. The device of claim 1 wherein said container is rectangular shaped with said top portion and said bottom portion meeting said side portions in approximately a perpendicular relationship to said back portion with fastener means detachably securing one of said side portions to said bottom portion.

6. A collapsible back pack cook stove, comprising, a container comprising a back portion, two opposite side portions, a top portion, and a bottom portion; said side portions being of substantially equal size;

said back and bottom portions being of substantially equal size;

first means pivotally connecting said side portions to the sides of said back portion;

second means pivotally connecting one end of said bottom portion to the bottom of said back portion;

third means pivotally connecting said top portion to the top edge of said back portion;

at least one spaced bracket pivotally secured to said back portion;

and means for selectively holding said bracket in a horizontal position with respect to said back portion;

said bracket being slidably secured to said back portion, and a retainer clip being secured to said back portion adjacent said bracket and being adapted to support said bracket in a horizontal position; said bracket being adapted to pivot to a vertical position when slidably disengaged from said retainer clip.

* * * * *